US007194221B2

(12) United States Patent
Kim et al.

(10) Patent No.: US 7,194,221 B2
(45) Date of Patent: Mar. 20, 2007

(54) IMAGE FORMING APPARATUS WITH HEAT DISSIPATION UNIT AND METHOD OF DISSIPATING HEAT IN SAME

(75) Inventors: Jin-yoon Kim, Gunpo-si (KR); Jae-young Jang, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 294 days.

(21) Appl. No.: 10/875,799

(22) Filed: Jun. 25, 2004

(65) Prior Publication Data

US 2005/0008389 A1 Jan. 13, 2005

(30) Foreign Application Priority Data

Jul. 3, 2003 (KR) ..... 10-2003-0044839

(51) Int. Cl.
*G03G 15/00* (2006.01)

(52) U.S. Cl. ..... 399/92; 399/94

(58) Field of Classification Search ..... 399/91, 399/92, 94, 95

See application file for complete search history.

(56) References Cited

U.S. PATENT DOCUMENTS 6,151,466 A * 11/2000 Fujiwara ..... 399/92
6,327,447 B1 12/2001 Nakano et al.
7,003,242 B2 * 2/2006 Kida ..... 399/92
7,013,099 B2 * 3/2006 Shirakata ..... 399/92
7,020,411 B2 * 3/2006 Awaya ..... 399/92

FOREIGN PATENT DOCUMENTS

| | | |
|---|---|---|
| JP | 56-035147 | 4/1981 |
| JP | 06-148996 | 5/1994 |
| JP | 11-015357 | 1/1999 |
| JP | 11-268377 | 10/1999 |
| JP | 2000-003083 | 1/2000 |
| JP | 2000-293089 | 10/2000 |

* cited by examiner

*Primary Examiner*—William J. Royer
(74) *Attorney, Agent, or Firm*—Roylance, Abrams, Berdo & Goodman, L.L.P.

(57) ABSTRACT

An image forming apparatus includes a shielding member protruding from a top surface of an upper frame and forming a chamber portion having a predetermined area together with an upper cover of the main body covering the shielding member so as to include a plurality of heat dissipating holes perforated in the upper frame at predetermined intervals along a lengthwise direction, and a pump installed at one side of the chamber portion and blowing air into the chamber portion to form a laminar flow to prevent heat generated by a fusing roller from heating an upper cover of the image forming apparatus.

16 Claims, 7 Drawing Sheets

IMAGE FORMING APPARATUS WITH HEAT DISSIPATION UNIT AND METHOD OF DISSIPATING HEAT IN SAME

PRIORITY

This application claims priority under 35 U.S.C. §119(a) of Korean Patent Application No. 2003-44839, filed on Jul. 3, 2003, in the Korean Intellectual Property Office, the entire contents of which are incorporated herein by reference.

BACKGROUND OF THE INVENTION

1. Field of the Invention

The present invention relates to an image forming apparatus. More particularly, the present invention relates to an image forming apparatus having a heat dissipation unit that intercepts heat generated in a fusing unit and dissipates the heat.

2. Description of the Related Art

Typically, an image forming apparatus forms an electrostatic latent image on a photosensitive medium using a laser scanning unit in response to an image signal, develops the electrostatic latent image with a predetermined color using a developing unit, and thereby forms a desired image on a sheet of paper.

A typical image forming apparatus includes a fusing unit, which fuses the image onto the sheet of the paper by applying high-temperature heat to the image formed thereon. Since the temperature of the fusing unit is high, dissipated heat is transferred to a paper exhaust unit that exhausts the sheet of paper, by convection in which the air is used as a medium, and is then transferred to an upper cover of the image forming apparatus. As a result, the upper cover becomes hot to the user's touch.

Thus, in order to solve the problem in which the upper cover gets hot, a unit that dissipates heat generated in the fusing unit outside of the image forming apparatus is needed. Accordingly, Japanese Patent Publication No. 2000-293089, the entire contents of which are incorporated by reference, published on Oct. 20, 2003, discloses an exhaust device which dissipates heat generated in a fusing unit.

FIG. 1 is a cross-sectional schematic view of a structure of an image forming apparatus using a conventional heat dissipating unit. FIG. 2 is a perspective view of a fusing unit of FIG. 1. FIG. 3 is a cross-sectional view in which the fusing unit of FIG. 2 is cut perpendicular to a fusing roller.

Referring to FIGS. 1 through 3, a paper feed cassette 16 for stacking sheets of paper 18 is installed below a main body 15 to be loaded and unloaded. A pickup roller 17, which picks up the sheets of paper 18, and a laser scanning unit 24, which forms an electrostatic latent image on a photosensitive body 22 in response to an image signal, are installed above the paper feed cassette 16. The photosensitive body 22 on which the electrostatic latent image is formed using the laser scanning unit 24 is installed on a transfer path of the sheet of paper 18 to contact the sheet of paper 18. A toner cartridge 21 for storing toner surrounds the photosensitive body 22.

A transfer roller 26 faces the photosensitive body 22 such that the sheet of paper 18 is placed between the transfer roller 26 and the photosensitive body 22, and transfers the image formed on the photosensitive body 22 onto the sheet of paper 18.

A paper feed guide 19, which guides the sheet of paper 18 picked up by the pickup roller 17 into the main body 15, is placed at one side of the paper feed cassette 16. A resist roller 20 and a pinch roller 28, which transfer the sheet of paper 18 that passes the paper feed guide 19, are installed on the transfer path of the sheet of paper 18.

A fusing roller 31 and a pressing roller 32, which fuses the image transferred onto the sheet of paper 18 when the sheet of paper 18 is placed between the fusing roller 31 and the pressing roller 32, are installed above the photosensitive body 22 and the transfer roller 26 to face each other. A pair of paper exhaust rollers 34, which exhausts the sheet of paper 18 on which the image is fused, outside of the main body 15, are installed above the transfer roller 26.

A heat dissipating unit 33, which dissipates heat generated in the fusing roller 31, is installed above the fusing roller 31, the pressing roller 32, and the paper exhaust rollers 34.

In the heat dissipating unit 33, an external cover comprising a top surface external cover 33*f*, a rear surface external cover 33*j*, and a front surface external cover 33*i* are combined with an internal cover. The internal cover comprises a top surface internal cover 33*e*, a rear surface internal cover 33*h*, and a front surface internal cover 33*g* that are formed as a single body. An air path 36 through which air enters and leaves, is placed between the external cover and the internal cover.

Ventilation holes 40 through which air enters and leaves, are formed in the rear surface external cover 33*j*, and an opening 38, through which heat is dissipated by a fan 39, is formed in the front surface external cover 33*i*.

A ventilation hole 40 through which air enters and leaves, is formed in the rear surface external cover 33*j*, and an opening 38, through which heat is dissipated by a fan 39, is formed in the front surface external cover 33*i*.

In the conventional heat dissipating unit 33 having the above structure, heat generated in the fusing roller 31 is accommodated in the accommodation space 35 and is conducted to the air path 36 through the internal cover. The air that enters through the ventilation holes 40 when the fan 39 operates, flows along the air path 36 together with heat conducted through the internal cover and is exhausted through the opening 38.

The air path 36 and the accommodation space 35 formed by the external cover and the internal cover should have a sufficient size and the capacity of the fan 39 should be large enough so that the conventional heat dissipating unit 33 efficiently and effectively dissipates heat generated by the fusing roller 31. If the size of the heat dissipating unit 33 is increased, however, the size of the image forming apparatus increases, and it is difficult to decrease the size of the image forming apparatus.

SUMMARY OF THE INVENTION

The present invention provides an image forming apparatus having a heat dissipating unit which prevents heat generated in a fusing unit from being transferred to an external cover via convection and which dissipates heat.

According to an aspect of the present invention, there is provided an image forming apparatus comprising a paper exhaust unit that includes an upper frame and a lower frame rotatably supporting a plurality of paper exhaust rollers for exhausting a sheet of paper onto which an image is formed outside of a main body, and a heat dissipating unit that prevents heat generated in a fusing unit from being transferred to an upper cover of the main body via convection and dissipating heat. The heat dissipating unit includes a shielding member protruding from a top surface of the upper frame and forming a chamber portion having a predetermined area together with the upper cover of the main body covering the shielding member so as to include a plurality of heat dissipating holes perforated in the upper frame at predetermined intervals along a lengthwise direction. The heat dissipating unit also includes a pump installed at one side of the chamber portion that blows air into the chamber portion so that the air supplied from the pump to the chamber portion flows downstream from the upper frame through the heat dissipating holes, and then collides with the air that is naturally convected by heat generated by a fusing roller. The air then forms a laminar boundary layer flow having a predetermined thickness, and prevents heat from being transferred to the upper frame of the paper exhaust unit.

BRIEF DESCRIPTION OF THE DRAWINGS

The above aspects and advantages of the present invention will become more apparent by describing in detail an exemplary embodiment thereof with reference to the attached drawings in which.

DETAILED DESCRIPTION OF THE PREFERRED EMBODIMENTS

Figure 1:
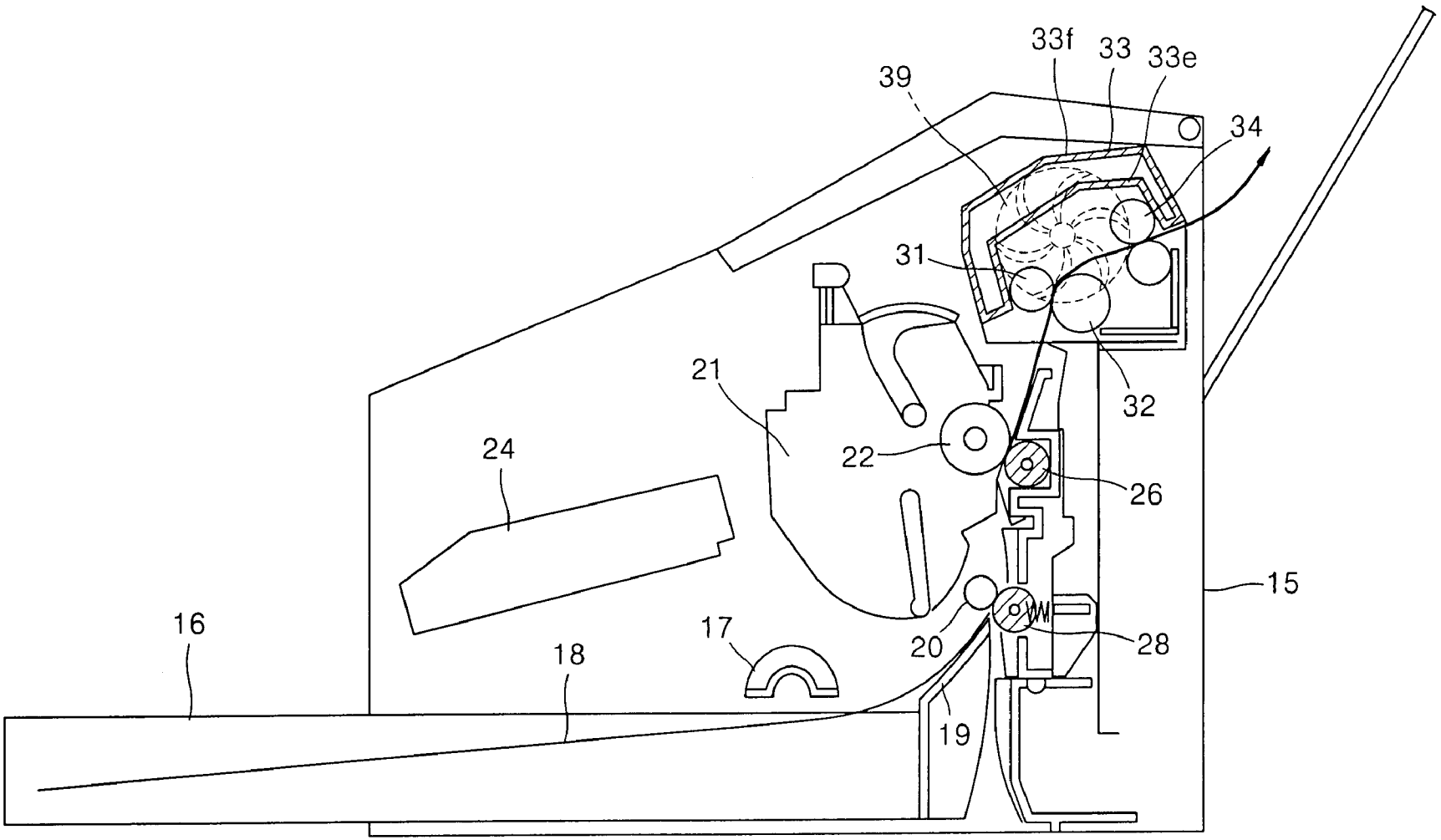
FIG. 1 (PRIOR ART)
FIG. 1 is a schematic cross-sectional view of a structure of an image forming apparatus using a conventional heat dissipating unit.
Figure 2:
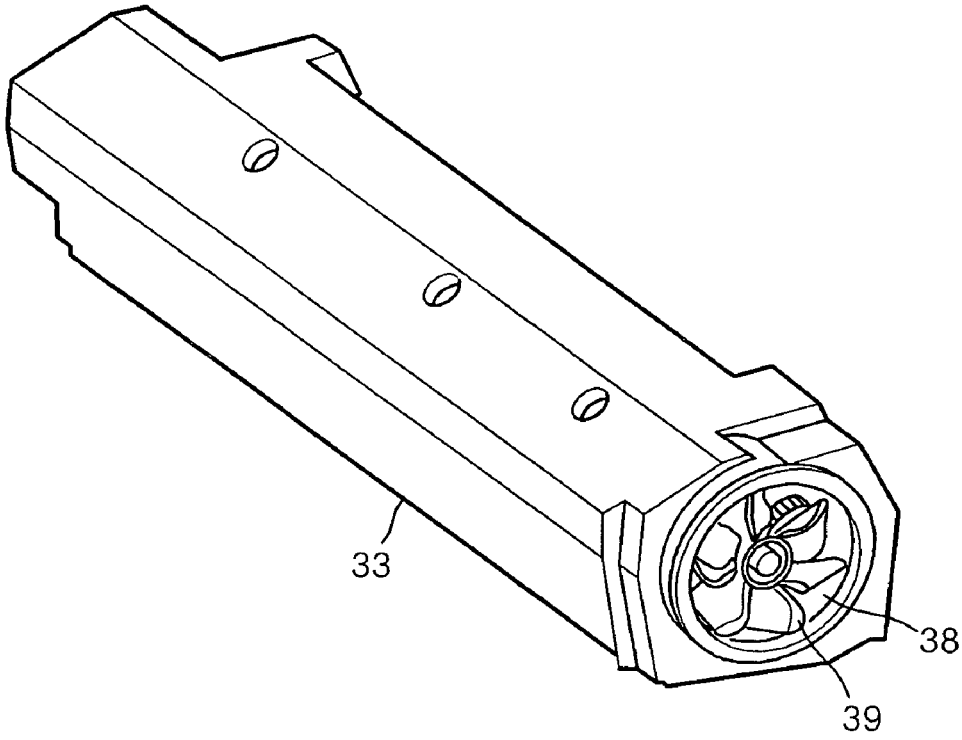
FIG. 2 (PRIOR ART)
FIG. 2 is a perspective view of a fusing unit of FIG. 1.
Figure 3:
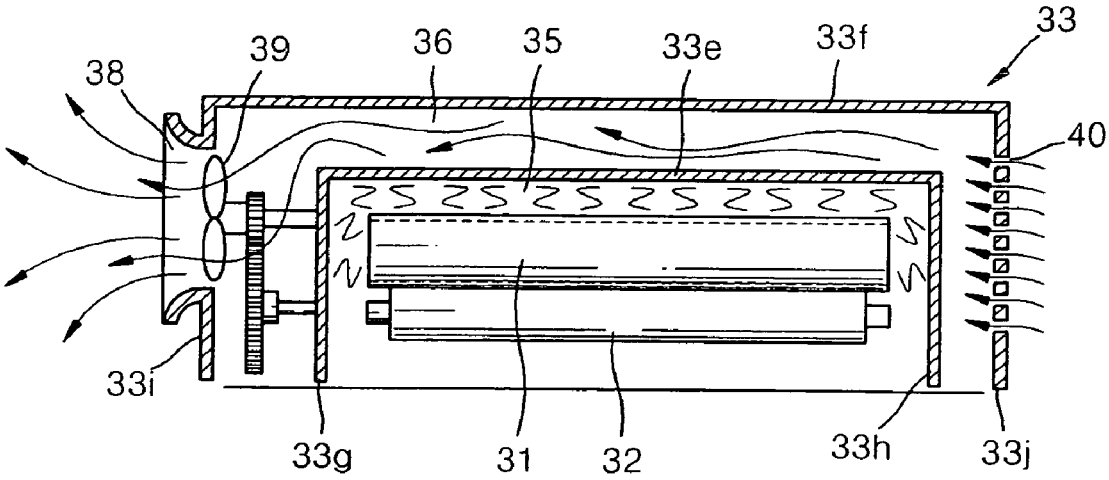
FIG. 3 (PRIOR ART)
FIG. 3 is a cross-sectional view in which the fusing unit of FIG. 2 is cut perpendicular to a fusing roller.
Figure 4:
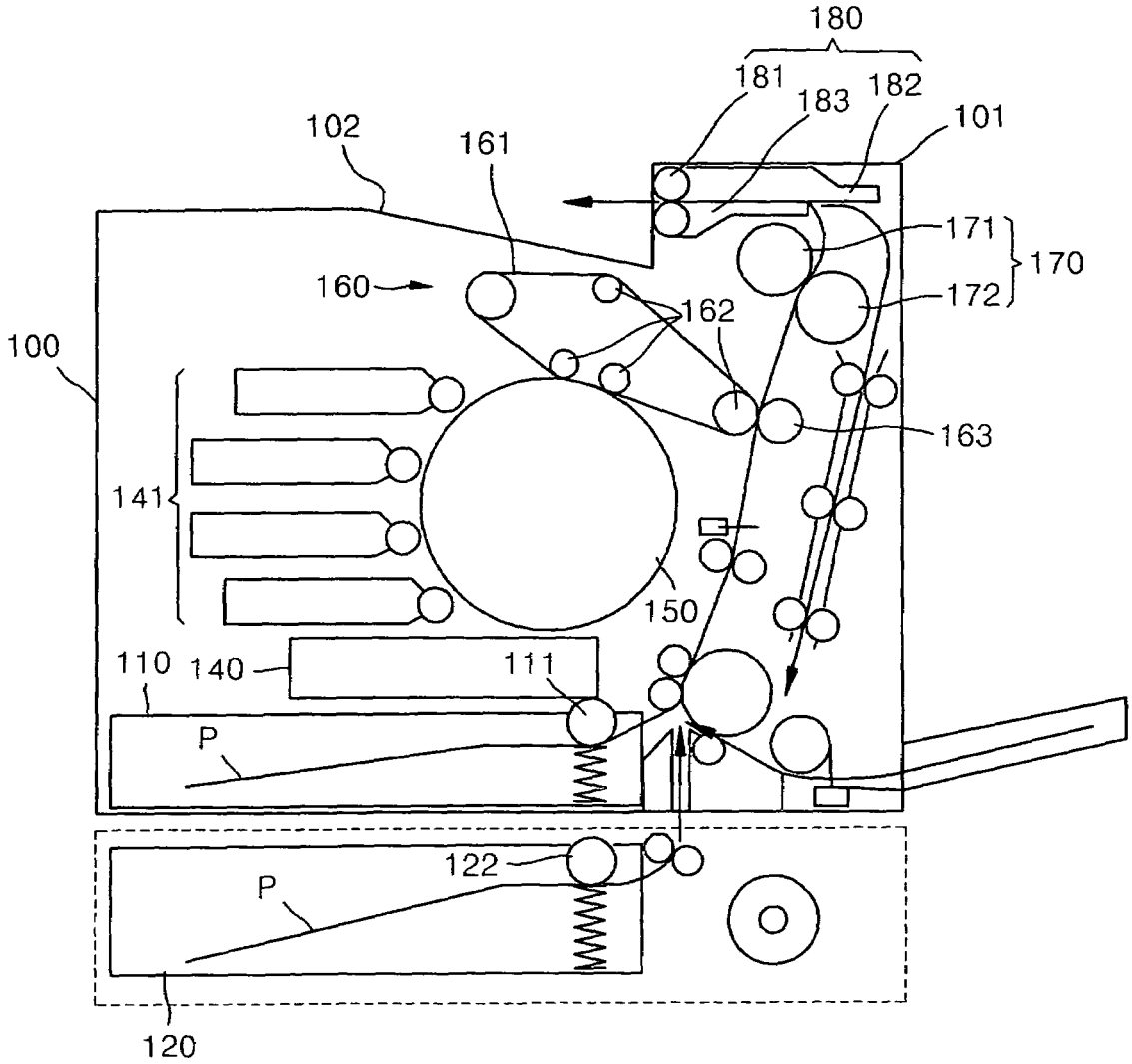
FIG. 4 is a schematic cross-sectional view of an image forming apparatus using a heat dissipating unit according to an embodiment of the present invention.
Figure 5:
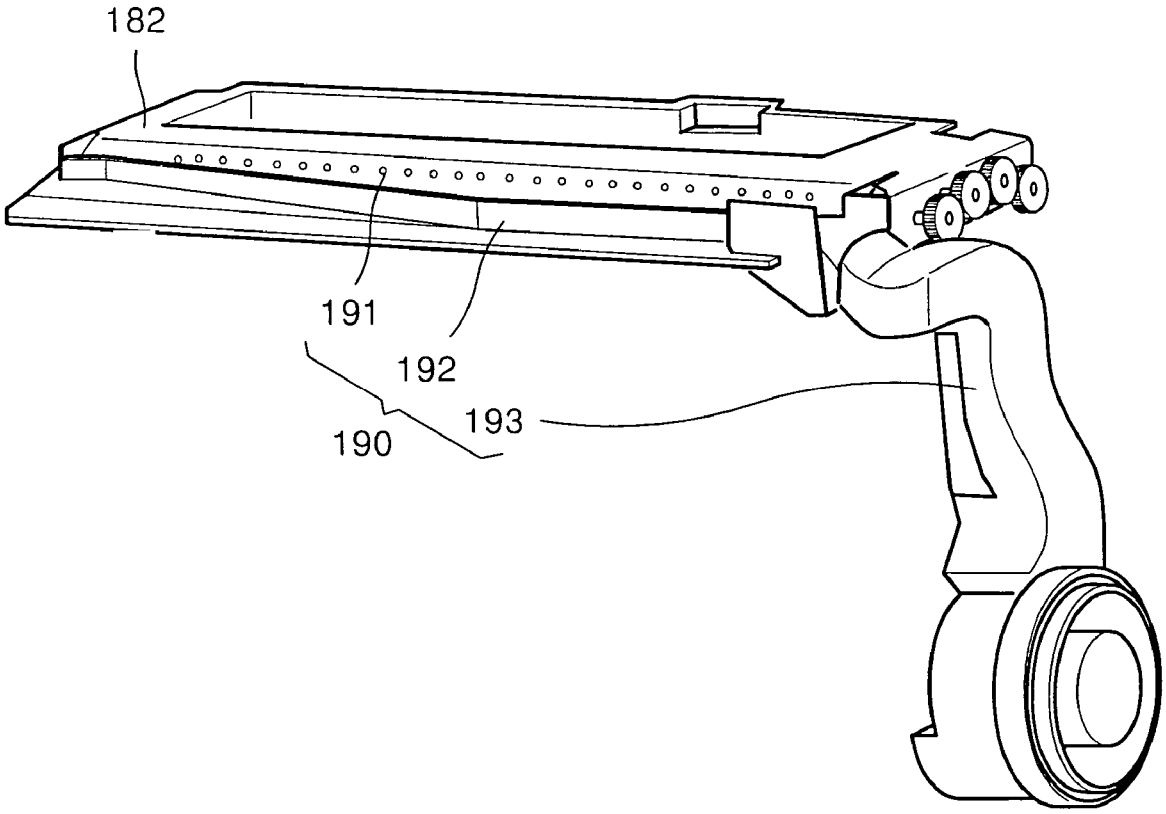
FIG. 5 is an extracted perspective view of the heat dissipating unit of FIG. 4.
Figure 6:
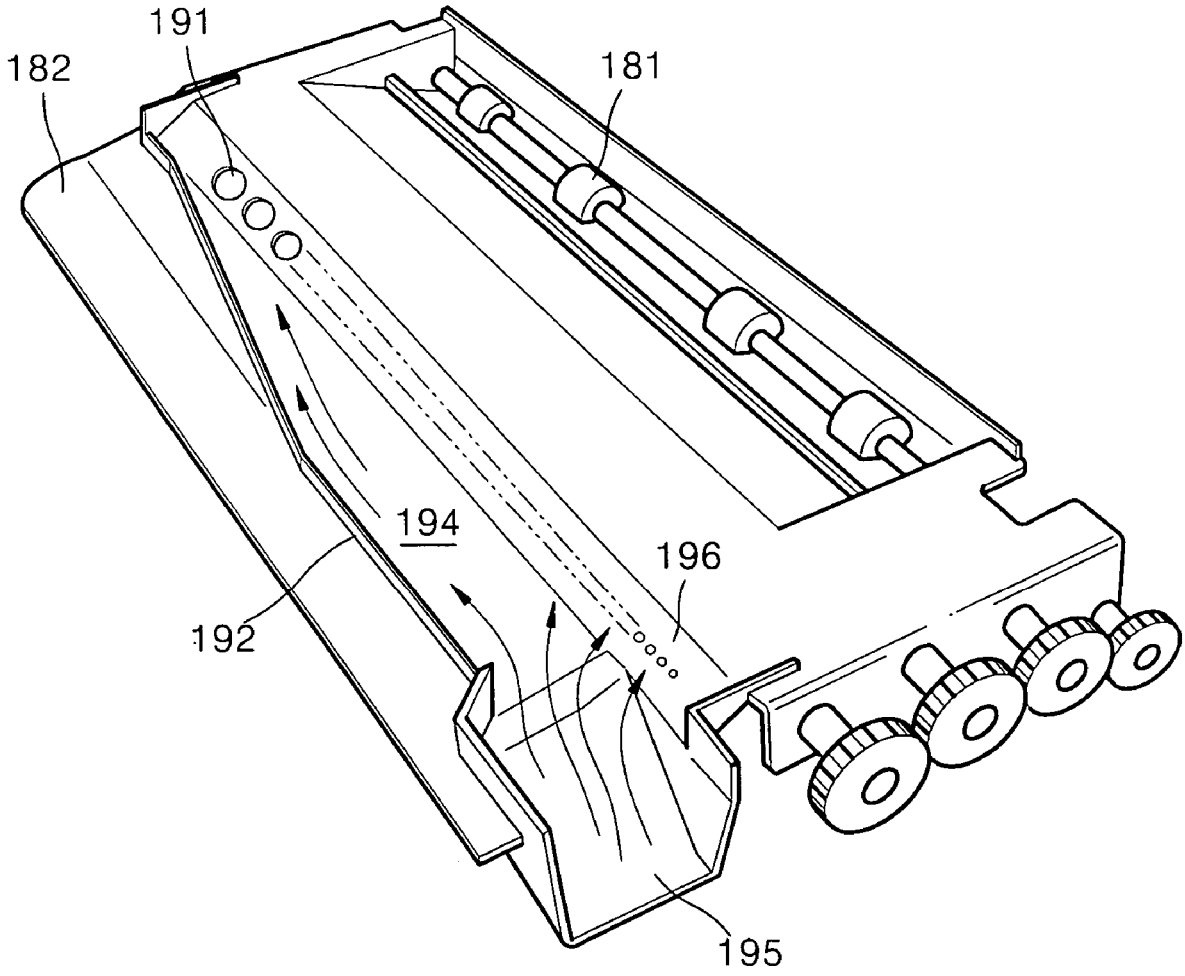
FIG. 6 is a partial perspective view of the heat dissipating unit of FIG. 4.

Referring to FIGS. 4 through 6, an image forming apparatus comprises first and second cassettes 110 and 120, a developing unit, a transfer unit 160, a fusing unit 170, a paper exhaust unit 180, and a heat dissipating unit 190.

The first and second cassettes 110 and 120 stack sheets of paper P on a lower portion of a main body 100 and can be attached to and removed from the main body 100. The second cassette 120 can be optionally installed. The sheet of paper P is picked up by pickup rollers 111 and 122, which are rotatably installed in the main body 100, and is transferred into the main body 100.

The developing unit comprises a plurality of ink cartridges 141 that contact a photosensitive drum 150 to develop an electrostatic latent image formed on the surface of the photosensitive drum 150 using a laser scanning unit 140 in response to an image signal, as a predetermined color image. Ink stored in the plurality of ink cartridges 141 is superimposed and developed on the electrostatic latent image so that the predetermined color image is formed.

The transfer unit 160 comprises a transfer belt 161 and a transfer backup roller 163. The transfer belt 161 is supported by a plurality of transfer belt backup rollers 162 and rotates on a closed curve. The color image formed on the surface of the photosensitive drum 150 is transferred onto the transfer belt 161. The transfer backup roller 163 faces any one of the plurality of transfer belt backup rollers 162 such that the transfer belt 161 is placed between one of the plurality of transfer belt backup rollers 162 and the transfer backup roller 163 and presses the sheet of paper P toward the transfer belt 161 so that the color image transferred onto the transfer belt 161 is transferred onto the sheet of paper P.

The fusing unit 170 comprises a fusing roller 171 which generates heat and a pressing roller 172 which faces the fusing roller 171 such that the sheet of paper P is placed between the fusing roller 171 and the pressing roller 172 and is pressed toward the fusing roller 171. The fusing roller 171 applies heat to the sheet of paper P on which a predetermined visible image is formed, fuses the visible image on the sheet of paper P, and is heated at over 180° C. Thus, part of the heat generated in the fusing roller 171 is transferred to the sheet of paper P, and the visible image is fused on the sheet of paper P. The rest of the heat is transferred to the paper exhaust unit 180 or another device connected to the fusing roller 171.

Figure 8:
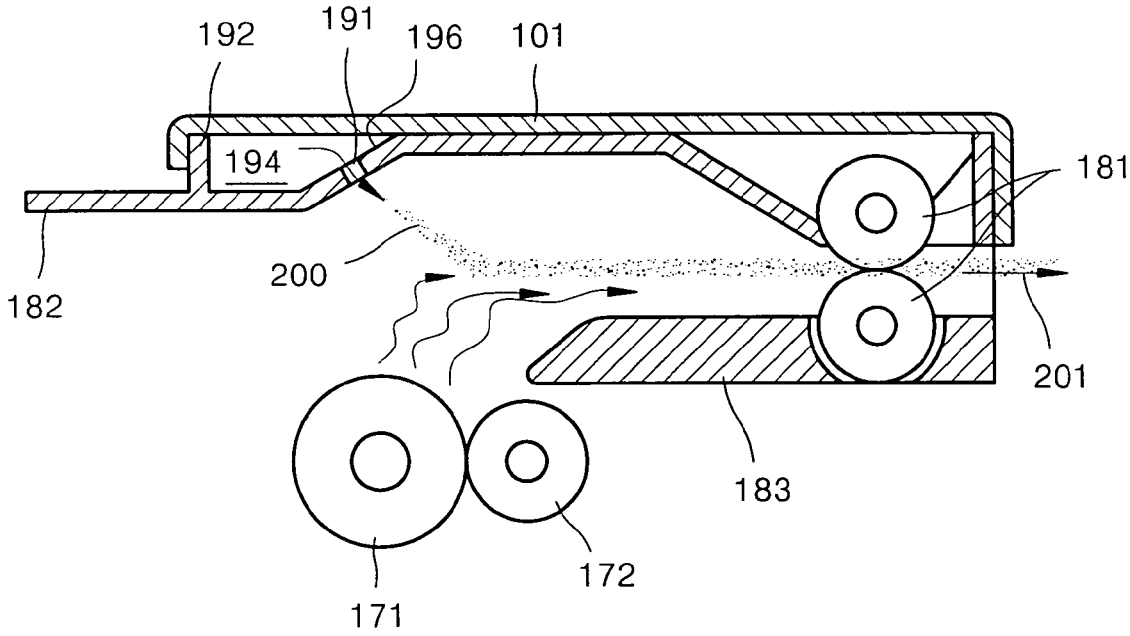
FIG. 8 is a cross-sectional view showing the functionality of the heat dissipating unit according to an embodiment of the present invention.

The paper exhaust unit 180 exhausts the sheet of paper P on which the predetermined visible image is formed, and is installed so that it can be attached to and detached from an upper portion of the main body 100. As shown in FIG. 8, the paper exhaust unit 180 comprises an upper frame 182 and a lower frame 183 that are combined with each other, and a plurality of paper exhaust rollers 181 are placed between the upper frame 182 and the lower frame 183 to contact each other and be rotatably supported. Thus, the sheet of paper P that passes through the fusing unit 170 is exhausted by paper exhaust rollers 181 and is stacked on a paper exhaust stand 102 (FIG. 4).

The heat dissipating unit 190 prevents heat generated in the fusing roller 171 from being transferred to an upper cover 101 of the main body 100. As shown in FIGS. 5 and 6, the heat dissipating unit 190 comprises one or more heat dissipating holes 191, a shielding member 192, and a pump 193.

At least one or more heat dissipating holes 191 are perforated in the upper frame 182 at predetermined intervals along a direction perpendicular to a lengthwise direction (the direction in which the sheet of paper P is transferred), and are formed on a top surface of the upper frame 182.

In one embodiment of the present invention, the size of each heat dissipating hole 191 gradually increases along the lengthwise direction. This is because the air supplied from the pump 193 along the lengthwise direction of the upper frame 182 passes through the heat dissipating holes 191 in the lengthwise direction under a constant pressure.

The shielding member 192 protrudes from the top surface of the upper frame 182 and forms a chamber portion 194 having a predetermined area including the heat dissipating holes 191 on the top surface of the upper frame 182. As shown in FIG. 8, the shielding member 192 is combined with the upper cover 101 of the main body 100, which is placed on the shielding member 192, to form the chamber portion 194 having the predetermined area. An opening 195 is located at one side of the chamber portion 194 so that the pump 193 is connected to the opening 195 and air is supplied by the pump 193.

Since the shielding member 192 is gradually bent toward the heat dissipating holes 191 along the lengthwise direction of the upper frame 182, the area of the chamber portion 194 gradually decreases along the lengthwise direction of the upper frame 182. In order to prevent the pressure of air supplied by the pump 193 through the opening 195 from also gradually decreasing along the lengthwise direction of the upper frame 182, the area of the heat dissipating holes 191 gradually increases along the lengthwise direction, and the pressure of the air that passes through the heat dissipating holes 191 is maintained at a constant level along the lengthwise direction.

Since the shielding member 192 is gradually bent toward the heat dissipating holes 191 along the lengthwise direction, the area of the chamber portion 194 gradually decreases along the lengthwise direction, and the area of the heat dissipating holes 191 gradually increases along the lengthwise direction so that the pressure of air supplied by the pump 193 to the chamber portion 194 and passes through the heat dissipating holes 191 is maintained at a constant level along the lengthwise direction.

Figure 7:
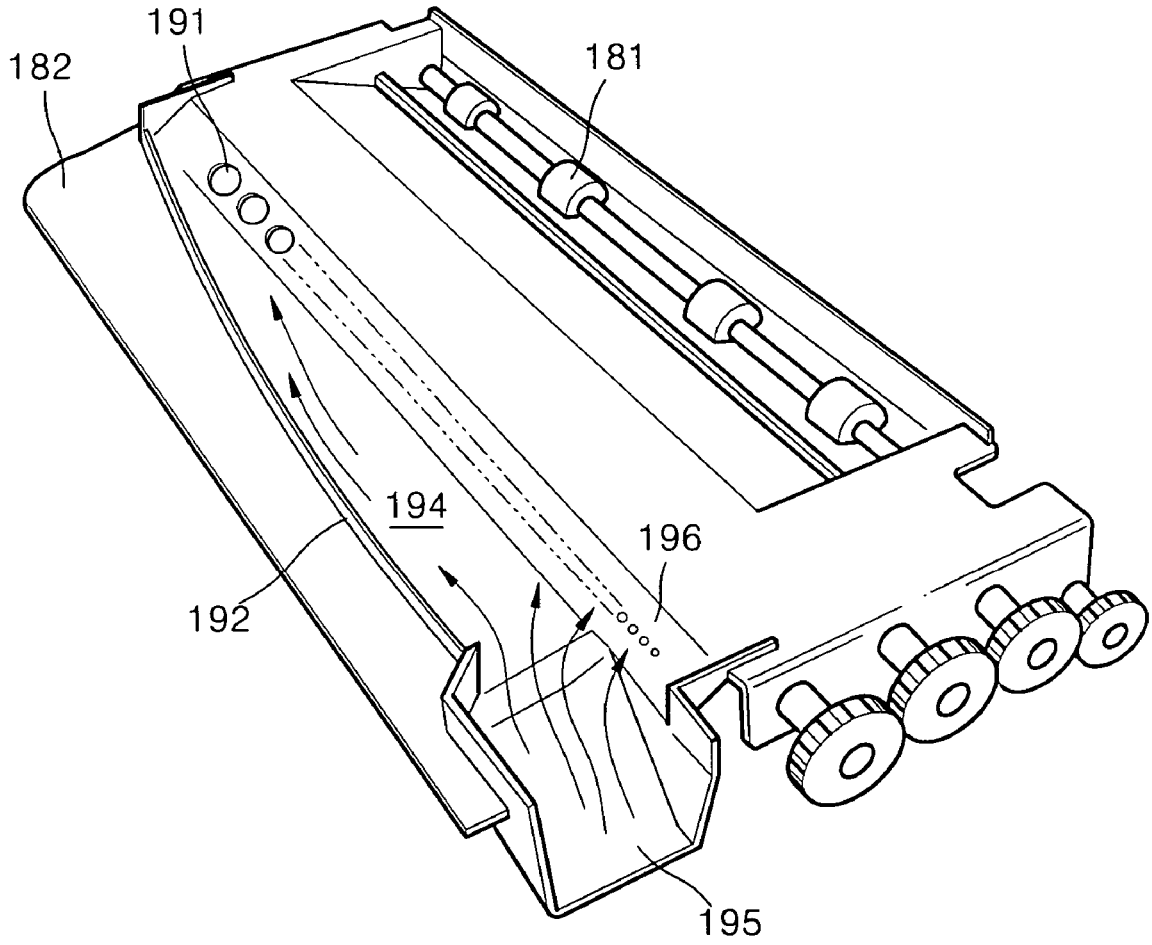
FIG. 7 is a partial perspective view of a heat dissipating unit according to another embodiment of the present invention.

In FIG. 6, the shielding member 192 bent toward the heat dissipating holes 191 has a linear shape as shown. As shown in FIG. 7, however, the shielding member 192 bent toward the heat dissipating holes 191 has an arc shape and accordingly, can have a variety of shapes. In general, when the shielding member 192 is bent toward the heat dissipating holes 191 along the lengthwise direction and the area of the chamber portion 194 decreases, and a variety of modified examples are possible.

Preferably, the heat dissipating holes 191 are formed on an inclined portion 196, which is inclined to the upper frame 182 in a direction opposite to the direction in which the sheet of paper P is exhausted by a predetermined angle. Thus, the air that passes the heat dissipating holes 191 can be inclined and can flow in the direction in which the sheet of paper P is exhausted. The heat dissipating holes 191 need not be formed, however, on the inclined portion 196. The heat dissipating holes 191 can be formed in a flat portion of the upper frame 182. The pump 193 is connected to the opening 195 and blows the air into the chamber portion 194.

Operation of the image forming apparatus using the heat dissipating unit 190 having the structure as described according to the exemplary embodiments of the present invention will now be described with reference to the accompanying drawings.

In accordance with natural heat flow phenomena, some of the heat generated by the fusing roller 171 is transferred to the upper frame 182 by natural convection. The air supplied from the pump 193 is blown into the chamber portion 194 through the opening 195. In general, the temperature of the air is above room temperature, yet lower than the temperature (about 180 ° C.) of the heat generated by the fusing roller 171. The air is blown into the chamber portion 194 by the pump 193 under a predetermined pressure and moves along the lengthwise direction. As the area of the chamber portion 194 decreases, the pressure of the air is maintained at a constant level along the lengthwise direction.

The air flows in the heat dissipating holes 191 along the lengthwise direction. As shown in FIG. 8, the air that passes through the heat dissipating holes 191 collides with heat (indicated by the wavy arrow lines), which is naturally convected up and away from the fusing roller 171. The dissipated air and naturally convected heat form a laminar boundary layer flow 200 having a predetermined thickness. The laminar boundary layer flow 200 and heat are transferred away from the fusing roller 171 and towards the paper exhaust roller(s) 181.

Accordingly, the heat, which is naturally convected from the fusing roller 171, collides with the laminar boundary layer flow 200 and is prevented from being transferred to the upper frame 182. The laminar boundary layer flow 200 flows in the direction that the sheet of paper P is exhausted. In FIG. 8 this is indicated by the arrow 201. Thus, the laminar boundary layer flow 200 together with heat, which is naturally convected from the fusing roller 171, is exhausted outside of the main body 100.

As described above, the image forming apparatus according to the present invention forms a laminar boundary layer flow by supplying cold air through a heat dissipating hole by using a pump, and heat that is transferred through natural convection from a fusing roller, is intercepted and is prevented from being transferred to an upper cover of a main body, such that a rise in temperature of the upper cover of the main body is prevented.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An image forming apparatus comprising:

a paper exhaust unit including an upper frame and a lower frame for rotatably supporting a plurality of paper exhaust rollers for exhausting a sheet of paper on which an image is formed outside of a main body and a heat dissipating unit for preventing heat generated in a fusing unit from being transferred to an upper cover of the main body via convection and dissipating heat, wherein the heat dissipating unit comprises:

a shielding member protruding from a top surface of the upper frame adapted to form a chamber portion having a predetermined area together with the upper cover of the main body covering the shielding member so as to include a plurality of heat dissipating holes perforated in the upper frame at predetermined intervals along a lengthwise direction; and a pump installed at one side of the chamber portion adapted to blow air into the chamber portion so that the air supplied from the pump to the chamber portion flows downstream from the upper frame through the plurality of heat dissipating holes, collides with the air that is naturally convected by heat generated by a fusing roller, forms a laminar boundary layer flow having a predetermined thickness, and prevents heat from being transferred to the upper frame of the paper exhaust unit.

2. The image forming apparatus of claim 1, wherein an area of the plurality of heat dissipating holes gradually increases along the lengthwise direction of the upper frame.

3. The image forming apparatus of claim 1, wherein the shielding member is bent toward the plurality of heat dissipating holes along the lengthwise direction of the upper frame, and a cross section area of the chamber portion gradually decreases along the lengthwise direction of the upper frame.

4. The image forming apparatus of claim 3, wherein the shielding member has an arc shape and is bent toward the plurality of heat dissipating holes along the lengthwise direction of the upper frame.

5. The image forming apparatus of claim 1, wherein an opening to which the pump is connected is formed at one side of the chamber portion.

6. The image forming apparatus of claim 1, wherein the plurality of heat dissipating holes are formed on an inclined portion, which is inclined to the upper frame in a direction opposite to a direction in which the sheet of paper is exhausted by a predetermined angle, and the air that passes the plurality of heat dissipating holes is inclined and flows in the direction where the sheet of paper is exhausted.

7. A method for dissipating heat in an image forming apparatus comprising:

blowing air such that it collides with naturally convected air generated by a fusing roller; forming a laminar boundary layer flow having a predetermined thickness; and transferring the heat generated by the fusing roller to a paper exhaust unit.

8. The method according to claim 7, wherein the step of forming a laminar boundary layer flow having a predetermined thickness comprises:

blowing air into a chamber portion so that the air supplied to the chamber portion flows downstream from an upper frame through the plurality of heat dissipating holes;

colliding the blown air with the air that is naturally convected by heat generated by the fusing roller, thereby forming the laminar boundary layer flow having a predetermined thickness.

9. The method according to claim 7, wherein the step of blowing air such that it collides with naturally convected air generated by the fusing roller comprises:

blowing air through a plurality of heat dissipating holes such that it collides with naturally convected air generated by the fusing roller.

10. The method according to claim 9, wherein the step of blowing air through a plurality of heat dissipating holes so that it collides with air that is naturally convected by heat generated by the fusing roller comprises blowing the air by a pump.

11. The method according to claim 9, wherein the step of blowing air through a plurality of heat dissipating holes such that it collides with naturally convected air generated by the fusing roller comprises:

pumping air through the plurality of heat dissipating holes formed in a shielding member adapted to form a chamber portion with a top surface of an upper frame of the paper exhaust unit.

12. The method according to claim 11, wherein an area of the plurality of heat dissipating holes gradually increases along the lengthwise direction of the upper frame.

13. The method according to claim 11, wherein the shielding member is bent toward the plurality of heat dissipating holes along the lengthwise direction of the upper frame, and an area of the chamber portion gradually decreases along a lengthwise direction of the upper frame.

14. The method according to claim 11, wherein the shielding member having an arc shape is bent toward the plurality of heat dissipating holes along a lengthwise direction of the upper frame.

15. The method according to claim 11, wherein the step of pumping air through the plurality of heat dissipating holes comprises pumping air with a pump disposed at an opening formed at one side of the chamber portion.

16. The method according to claim 11, wherein the plurality of heat dissipating holes are formed on an inclined portion, which is inclined to the upper frame in a direction opposite to a direction in which a sheet of paper is exhausted by a predetermined angle, and the air that passes through the plurality of heat dissipating holes is inclined and flows in the direction where the sheet of paper is exhausted.

* * * * *